United States Patent [19]

Fleissner

[11] Patent Number: 4,566,378

[45] Date of Patent: Jan. 28, 1986

[54] APPARATUS FOR HOOPING A FIBER BALE IN A FIBER BALE PRESS

[75] Inventor: Gerold Fleissner, Egelsbach, Fed. Rep. of Germany

[73] Assignee: Vepa Aktiengesellschaft, Riehen/Basel, Switzerland

[21] Appl. No.: 730,249

[22] Filed: May 3, 1985

Related U.S. Application Data

[63] Continuation of Ser. No. 643,742, Aug. 21, 1984, abandoned, which is a continuation of Ser. No. 489,115, Apr. 27, 1983, abandoned.

[30] Foreign Application Priority Data

May 6, 1982 [DE] Fed. Rep. of Germany ..... 3216883
Jul. 17, 1982 [DE] Fed. Rep. of Germany ..... 3226832

[51] Int. Cl.[4] ..... B65B 13/04

[52] U.S. Cl. ..... 100/26; 24/23 W; 100/3; 100/30

[58] Field of Search ..... 100/3, 26, 29, 30; 53/589

[56] References Cited

U.S. PATENT DOCUMENTS

| | | | |
|---|---|---|---|
| 242,369 | 5/1881 | Ritter, Jr. | 206/83.5 |
| 443,619 | 12/1890 | Orr | 100/3 X |
| 443,620 | 12/1890 | Orr | 206/83.5 |
| 656,028 | 8/1900 | Lantz | 24/28 |
| 1,222,930 | 4/1917 | Cary | 24/28 |
| 1,427,866 | 9/1922 | Tevander | 24/28 |
| 1,727,896 | 9/1929 | Mraz | 24/23 W X |
| 1,948,719 | 2/1934 | King | 24/23 W |
| 2,659,187 | 11/1953 | Barnes | 206/83.5 X |
| 2,831,422 | 4/1958 | Black et al. | 100/30 X |
| 2,966,816 | 1/1961 | White | 100/30 X |
| 2,986,787 | 6/1961 | Ackermann | 24/28 |
| 3,101,663 | 8/1963 | Hall et al. | 100/30 |
| 3,701,314 | 10/1972 | Tull, III | 100/30 X |
| 3,834,297 | 9/1974 | Huson | 100/30 X |

FOREIGN PATENT DOCUMENTS

| | | | |
|---|---|---|---|
| 644455 | 4/1937 | Fed. Rep. of Germany | 24/23 W |

*Primary Examiner*—Billy J. Wilhite
*Attorney, Agent, or Firm*—W. G. Fasse; D. H. Kane, Jr.

[57] ABSTRACT

A fiber bale press is equipped with a hooping mechanism for applying wire-hoops to a fiber bale produced by the press. The press has at least one pressing plate and a counter pressure plate as well as a hoop material supply device. The hoop material is steel wire cut to suitable lengths for forming hoops. The steel wire ends are secured to each other by a sealing member, such as a tubular metal sleeve, which receives one steel wire end in each of its ends. The tubular metal sleeve is rigidly secured to the ends of the hoop forming wire by a crimping mechanism. Preferably the steel wires are hooped around a bale in a cross-over relationship so that at least the wire-hoops close to and in parallel to a bale edge are held in place by wire-hoops running perpendicularly to the bale edge. This mechanism avoids loops at the ends of the baling wire.

7 Claims, 12 Drawing Figures

APPARATUS FOR HOOPING A FIBER BALE IN A FIBER BALE PRESS

This application is a continuation of application Ser. No. 643,742, filed Aug. 21, 1984, which in turn is a continuation of U.S. application Ser. No. 489,115, filed on Apr. 27, 1983 both now abandoned.

BACKGROUND OF THE INVENTION

The invention relates to an apparatus for hooping a fiber bale in a fiber bale press. Such a fiber bale press is equipped with means for hooping a fiber bale and it includes at least one pressing plate, as well as a counter pressure plate and a mechanism for supplying the hooping material.

Fiber bales coming out of a fiber baler or press must be provided with hoops prior to completely emerging from the baler in order not to fall apart. Heretofore it has been customary to use flat metal strips for this purpose and to connect the ends of the flat metal strips forming a hoop by point welding. It is further known to make the hoops of wires, each of which is provided with loops at its ends for interconnecting the wire ends to each other. The loops require an unnecessarily large quantity of wire and the mechanical devices for binding the wire are rather complicated and hence expensive. An additional characteristic of prior art fiber balers employing wire hoops is seen in that they are rather trouble-prone.

OBJECTS OF THE INVENTION

In view of the above it is the aim of the invention to achieve the following objects singly or in combination:

to provide a fiber baler with a hooping mechanism which easily and efficiently provides the fiber bales with hoop means for holding the bales together;

to use steel wire for the hoops without any end connecting loops; and to provide a connection between the wire ends which is capable of taking up loads exceeding the tensile strength of the hooping steel wires.

SUMMARY OF THE INVENTION

According to the invention the hoops around a fiber bale are made of steel wire without any loops at the ends and the wire ends are secured to each other by a seal.

The steel wire used according to the invention is preferably a non-directional wire such as a spring hardened steel wire which has in its installed condition a given tensile strength. Due to the "lead seal" which does not necessarily have to be made of lead but especially of steel, the tensile strength of the steel wire at the connecting point is reduced only by a few percentage points relative to its given maximum tensile strength so that the tensile strength of the hooping material is utilized in an optimal manner.

The seal comprises, for example, a metal sleeve which is pressed or crimped by a respective crimping tool in such a manner that the sealing sleeve is provided with a plurality of waves in its longitudinal direction. Due to such crimping shape the seal is capable of being exposed to a multiple of the loads actually occurring. In other words, the seal is capable of withstanding loads exceeding the breaking tensile strength of the steel wires forming the hoops.

Further features of the invention may be taken from the following description and from the claims in conjunction with the drawings.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
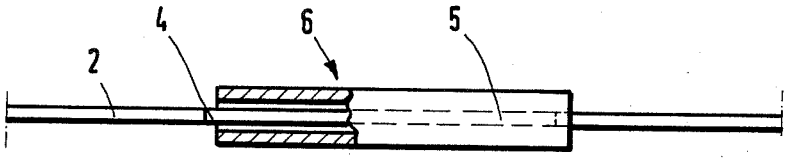
FIG. 1 shows a seal partially in section and prior to crimping with two wire ends inserted into the seal.
Figure 4:
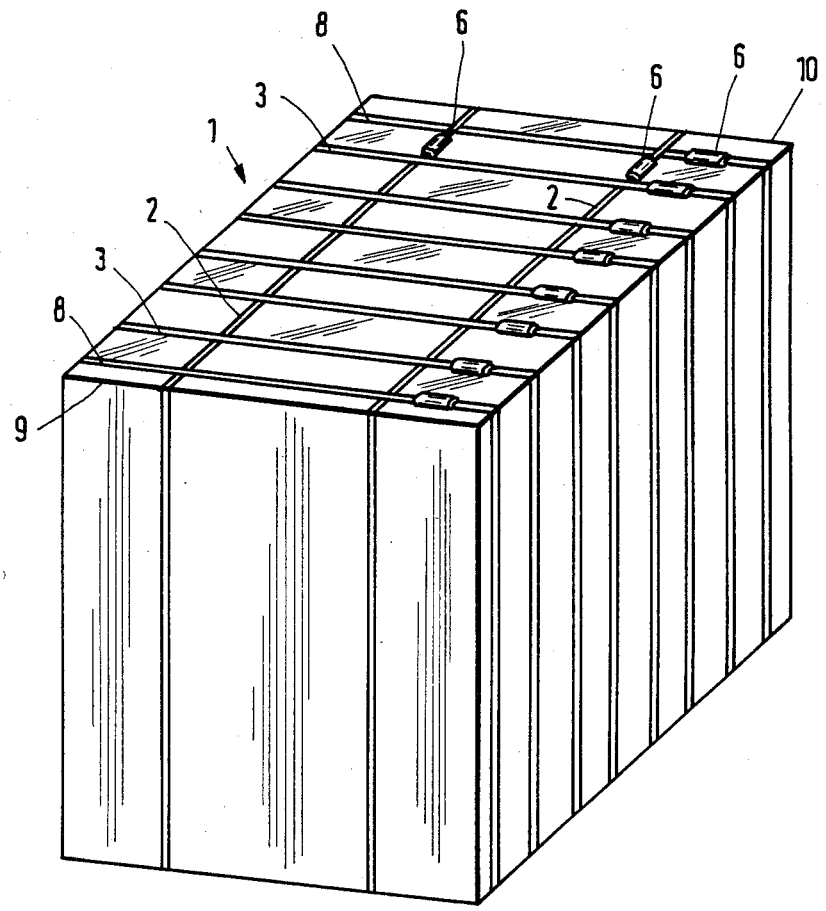
FIG. 4 shows a bale provided with wire-hoops according to the invention.

FIG. 4 shows the hooped bale 1 provided with steel wire-like hoops 2 extending in the longitudinal direction of the bale and with steel wire-like hoops 3 extending cross-wise to the wires 2. The ends 4, 5, as shown in FIG. 1 of the wires forming the hoops 2 and 3 are interconnected by a seal 6 in a tension load transmitting manner. The wires forming the hoops 2 and 3 are made of non-directional, spring hardened steel and the seal 6 is made of a metal especially steel-sleeve as best seen in FIG. 1. Prior to the crimping operation the metal or steel sleeve forming the seal 6 has a clearance inner diameter of sufficient size for the easy insertion of the wire ends 4 and 5 until these ends exit completely or almost at the opposite end of the sleeves. Thus, the wire ends extend initially in parallel to each other without any wire loops.

Figure 2:
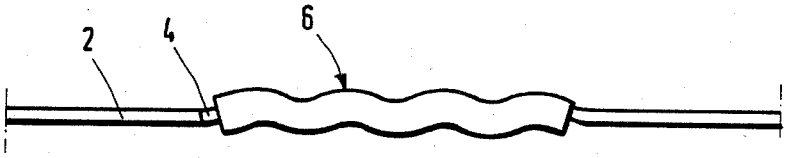
FIG. 2 is a side view of the seal after the crimping operation.
Figure 3:
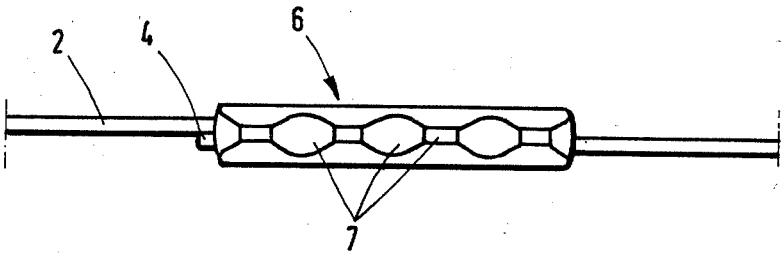
FIG. 3 is a bottom view of the seal according to FIG. 2.

The sealing is accomplished by crimping the metal sleeve 6 to press it and the wire ends into a wave shape as shown in FIG. 2, whereby about three or four ridges and valleys are formed along the length of the sleeve as shown in FIGS. 2 and 3. FIG. 3 further shows that a plurality of pressure surfaces 7 are formed on the surface of the seal sleeve 6.

The steel wires forming the hoops 2 and 3 are suitably placed around the bale 1 in such a manner that an over and under relationship is accomplished at least for those wires located in parallel or close to an edge of the bale, please see the wires 2 and 8 in FIG. 4. This feature makes sure that especially the wires 8 located close to an edge 9 or 10 of the bale 1 are prevented from slipping off the bale.

The essential features of the fiber baler 11 and of the hooping means 12 for placing wires around the bale 1 will now be described with reference to FIGS. 5 to 12 to the extent necessary for understanding the invention.

Figure 5:
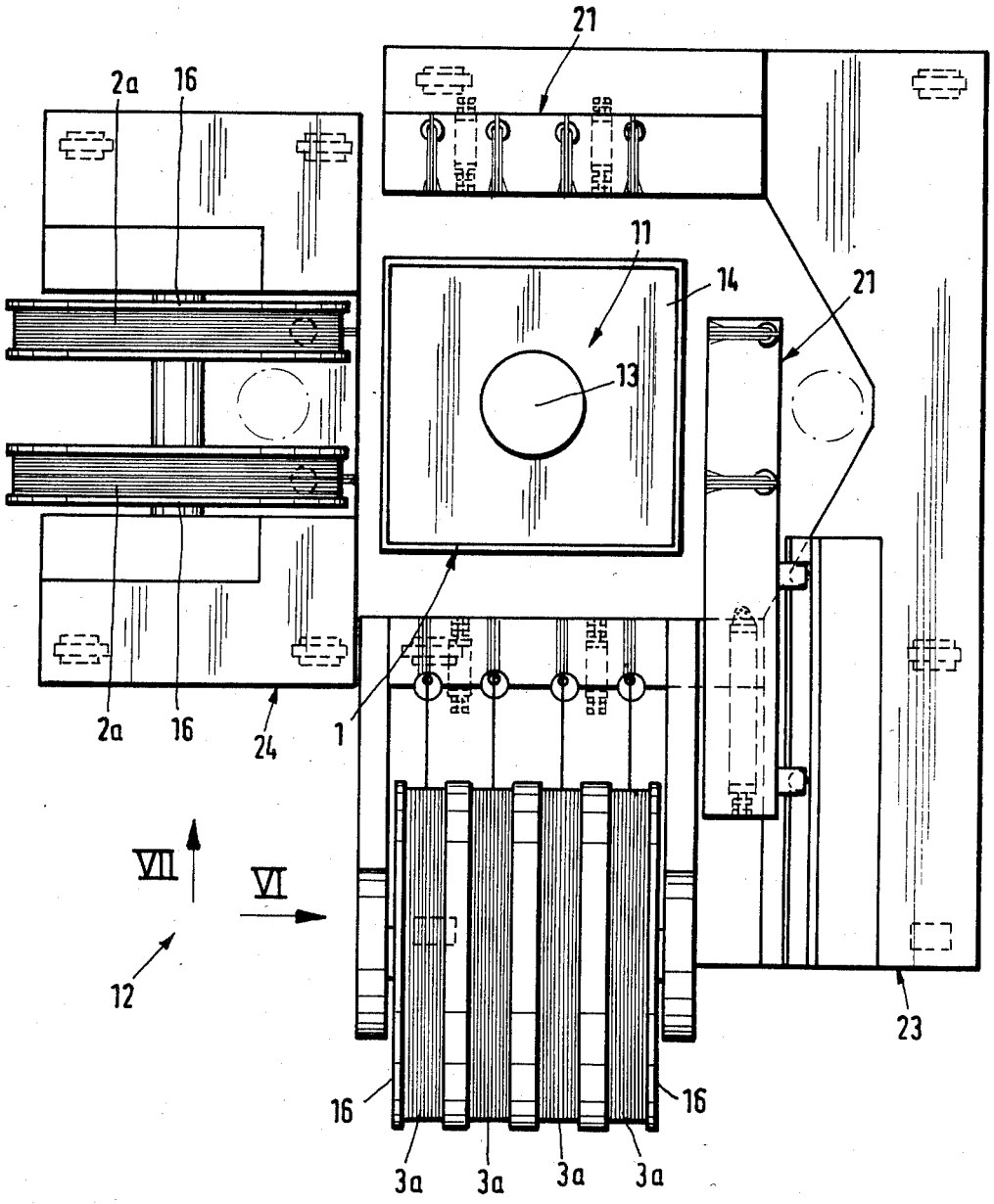
FIG. 5 shows a top plan view onto a fiber baler or press comprising a mechanism for wire-hooping a fiber bale.
Figure 6:
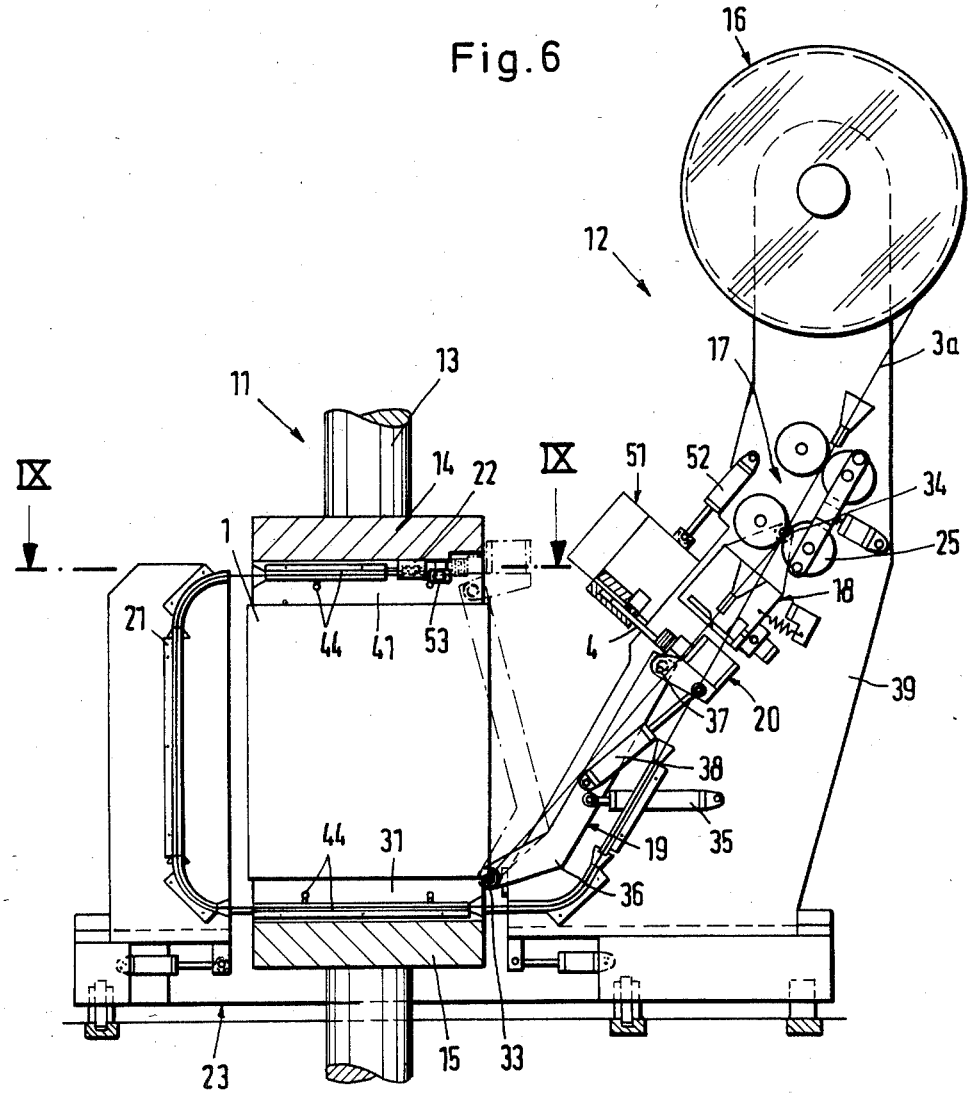
FIG. 6 is a view, partially in section, in the direction of the arrow VI in FIG. 5.
Figure 7:
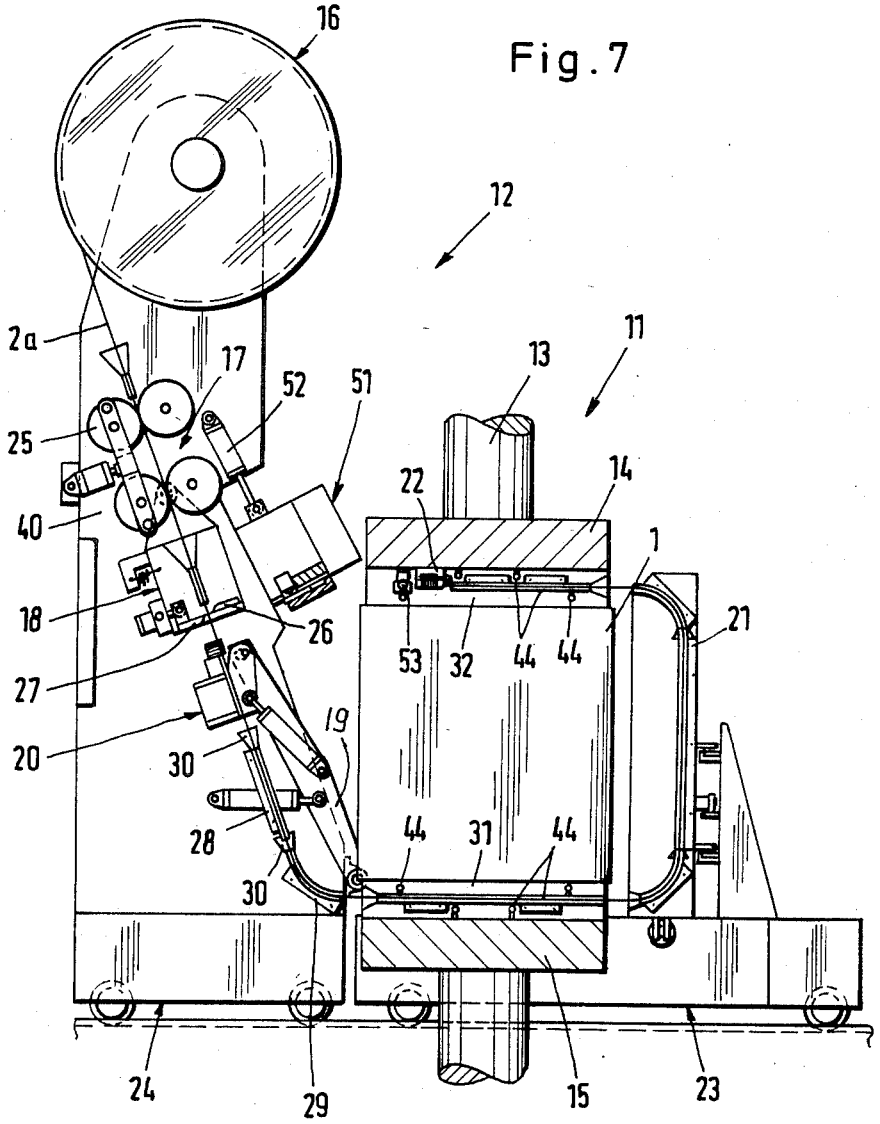
FIG. 7 is a view, partially in section, in the direction of the arrow VII in FIG. 5.

FIG. 5 shows a centrally located press ram 13 and a pressing plate 14 cooperating with a counter pressure plate 15 shown in FIGS. 6 and 7. The hooping means 12 comprise hooping steel wire feeding and handling means including a wire magazine or wire supply roller 16, a feeding mechanism 17, a cutting mechanism 18, a tilting mechanism 19 including a bending mechanism 20 as well as guide means 21 and holding and sealing or seal securing means 22 for each of the wires coming as continuous steel wire lengths 2*a* or 3*a* from the rollers 16. Thus, it will be appreciated that the just enumerated mechanisms and means are provided individually for each steel wire 2 or 3 extending longitudinally and cross-wise around a fiber bale 1. This applies also to the steel wires 8, however, these mechanisms for the steel wires 8 are not shown since they are of the same construction as the mechanisms which are shown.

The mechanisms 16 to 21 for the steel wire 3*a* are mounted on a carrier or carriage 23 in the example embodiment shown in FIGS. 5 and 6. The carriage 23 reaches in its working position shown in a plan view in FIG. 5 around the pressing plate 14 and around the fiber bale 1 in a U-shaped manner. The carrier or carriage 23 is movable, for example on rails so that the fiber bale 1 is accessible after the carriage reaches around the fiber bale and so that the fiber bale may also be retrieved from the baler 11.

The mechanisms 16 to 20 for the steel wires 2*a* are identical to the same mechanisms for the steel wire 3*a*. Hence, the same reference numbers are used for these mechanisms mounted on a carrier or carriage 24 shown in FIGS. 5 and 7 as for the mechanisms mounted on the carriage 23. The carriage 24 is also movable toward and away from the fiber baler 11.

The guide means 21 for the steel wires 2*a* and 3*a* are located on the carrier or carriage 23 as best seen in FIGS. 5 and 7.

The fiber baler 11 and the hooping mechanism 12 operates as follows. Such operation is identically the same for the steel wires 2*a* or 3*a* and the wire 8. Such operation comprises the following steps referring first to FIGS. 6 and 7. The wire feeding or supply mechanism 17 pulls steel wire 2*a* off the roller 16 by means of its positively driven pulling and tensioning rollers 25. The wire is pushed through the cutting mechanism 18 having two knives 26 and 27 for severing a length of wire 2*a* which then moves into the bending mechanism 20. Downstream of the bending mechanism 20 the steel wire 2*a* moves into a guide channel 31 in the counter pressure plates 15 while threading through guide elements 28 and 29 having funnel shaped inlets 30. Downstream of the guide channel 31 the wire moves through the guide means 21 to the pressing plate 14. The pressing plate 14 also comprises for each steel wire 2*a* a guide channel 32 and the guide means with the respective funnel shaped inlets as well as the holding and seal securing means 22. The seal securing means 22 grip and hold an end of the steel wire 2*a* when the latter has been inserted, whereupon the pulling and tensioning rollers 25 of the supply mechanism 17 rotate in the reverse direction to thereby securely hold the steel wire 2*a* against the fiber bale 1. This holding takes place only when all steel wires 2*a*, 3*a* or 8 have been pushed in the guide channels 31 and 32 and when they have been gripped by the holding and seal securing mechanism 22. When the steel wires 2*a* and 3*a* are tensioned, the wires slide out of the guide channel 31, 32 and out of the guide means 21 so that the wire may be taken up by the bending mechanism 20, whereupon it is cut by the knives 26, 27 of the cutting mechanism 18. Thus, the cutting takes place after the steel wires 2*a* or 3*a* have been tensioned.

During the tensioning the steel wire 2*a*, 3*a* changes its position not only in the range of the fiber bale 1, but also between the edge 33 of the fiber bale 1 and the next adjacent pulling and tensioning rollers 25 facing the respective edge 33 as may be seen from the wire position shown in FIG. 6, illustrated by dash-dotted lines. In order to compensate this positional change of the wire or wires, the cutting mechanism 18 is mounted for tilting about an axis 34 located at a level of the axes of the adjacent pulling and tensioning rollers 25, please see FIG. 6.

The tilting mechanism 19 is tiltable with the aid of a drive 35 to thereby move the tilting mechanism 19 toward the fiber bale 1 about a tilting axis coinciding with the edge 33 of the fiber bale. The tilting mechanism 19 comprises a bent tilting arm 36 and carries at the free end 37 the bending mechanism 20 eccentrically mounted to said free end 37 and driven by a drive 38 for the tilting movement. The bending mechanism 20 grips the steel wire 3*a* as shown in FIG. 6 after the tensioning and prior to the cutting to thereby bend the free end 4 toward the fiber bale 1. At this time a seal 6 in the form of a metal sleeve is released from a magazine 51 in such a manner that the sleeve 6 slides onto the free end 4 of the steel wires 3*a*. The magazine 51 is slidable out of the movement path of the bending mechanism 20 by means of a drive 52. As soon as the magazine 51 has been moved out of the way, the tilting mechanism 19 tilts the steel wire 3*a* which is still under tension until its end 4 reaches into the holding and seal securing mechanism 22 in the pressing plate 14 as indicated by dash-dotted lines in FIG. 6. At this point the metal sleeve 6 threads itself onto the other end 5 of the steel wire 3*a* whereupon it is crimped by the crimping tool 53 to form the seal. Reference is made in this connection also to FIGS. 9 and 12 and the following description thereof. The wire supply or feeding roller 16, as well as the cutting mechanism 18 and the tilting mechanism 19 are mounted on machine frame members 39 or 40 respectively which in turn are mounted on the carrier or carriage 23, 24.

Figure 8:
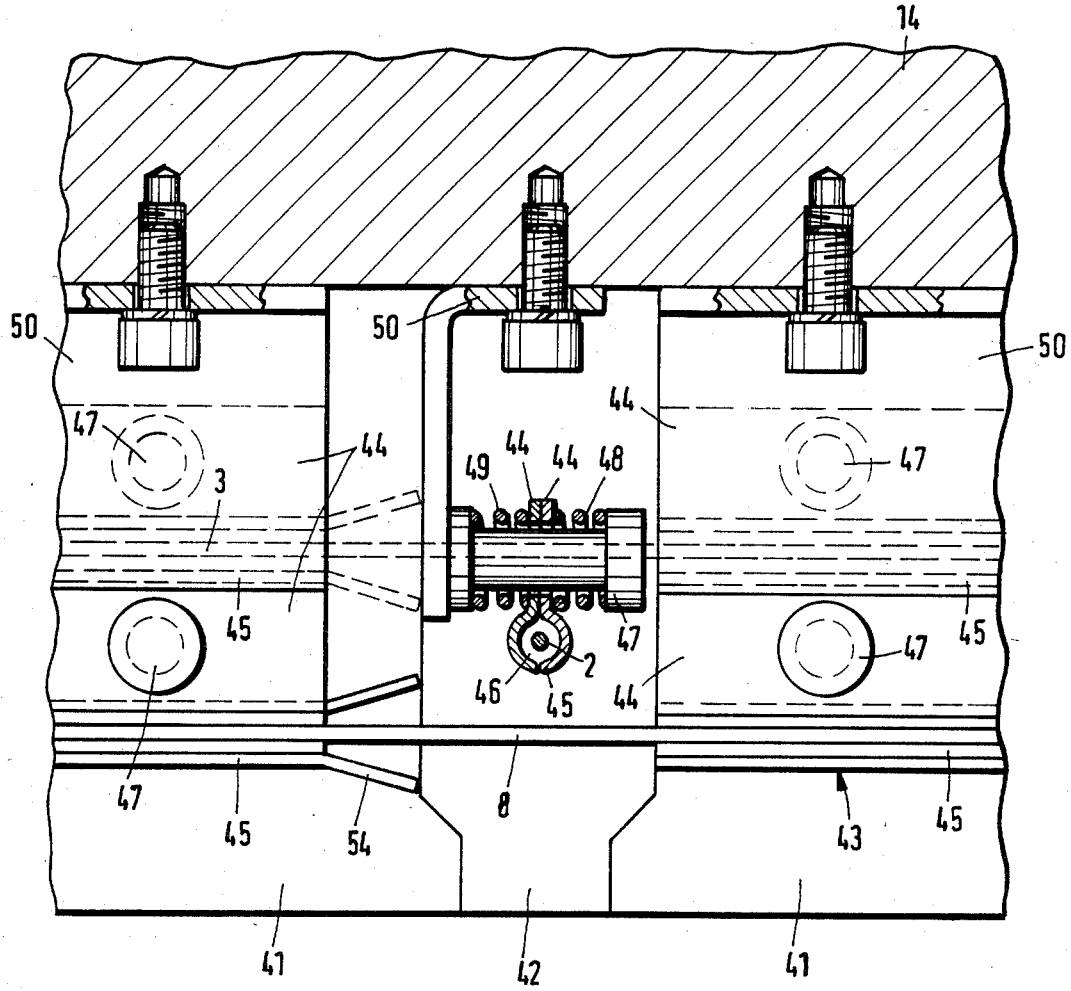
FIG. 8 shows a sectional view through a pressing plate with guide channels for the hooping wires, whereby the illustration is on an enlarged scale as compared to the previous figures.

FIG. 8 shows on an enlarged scale two guide channels 41 and 42 which cross each other in the pressing plate 14 for the steel wires 2, 3 and 8 which also cross each other and are located in different planes. The guide channels 41 and 42 correspond substantially to the guide channels 31 and 32 in FIG. 7.

Separate inserts 43 which may be provided as multiple component inserts, are located in each of the guide channels 41 and 42 to function as guide means for the steel wires 2, 3 and 8. These inserts 43 are located in the zone of the respective other guide channel. These inserts 43, or rather these guide means, comprise two respective guide rails or moldings 44 facing each other and touching each other in the longitudinal direction. Each rail or molding 44 has an approximately semi-circular cross-sectional shape, as well as a bent edge 45 so located that the two edges 45 face each other. These edges 45 form a guide channel 46 having the shape of tubular half shells for the steel wire 2. The steel wires 3 and 8 located in the other guide channels 41 or 42 in other planes are also located between the semi-circular bent edges of respective guide rails or moldings 44 as is shown in principle in FIG. 8.

The guide rails or moldings 44 are secured in the guide channels 41, 42 crossing each other with the aid of bolts 47 passing through passage openings in the guide rails or moldings 44. Further, springs 48, 49 bearing against the bolt 47 press the respective two guide rails or moldings 44 forming a pair, toward each other. The bolt or bolts 47 in turn are secured to angle brackets 50 having bracket legs of differing lengths if required for holding bolts 47 and guide rails 44 in two different planes if desired.

As soon as the steel wires 2, 3 and 8 are subjected to a substantial tension, the wires will press the edges 45 apart against the force of the springs 48 and 49, whereby these edges 45 act as claws which release the wire when the tensioning is applied, whereby the wire passes out of the respective channel 46 to lie directly against the side of a fiber bale 1.

The inlets or rather, ends 54 of the tubular edges 45 of the guide rails or moldings 44 are funnel shaped so that the free end of the steel wire may find its way automatically during the feed advance.

Figure 9:
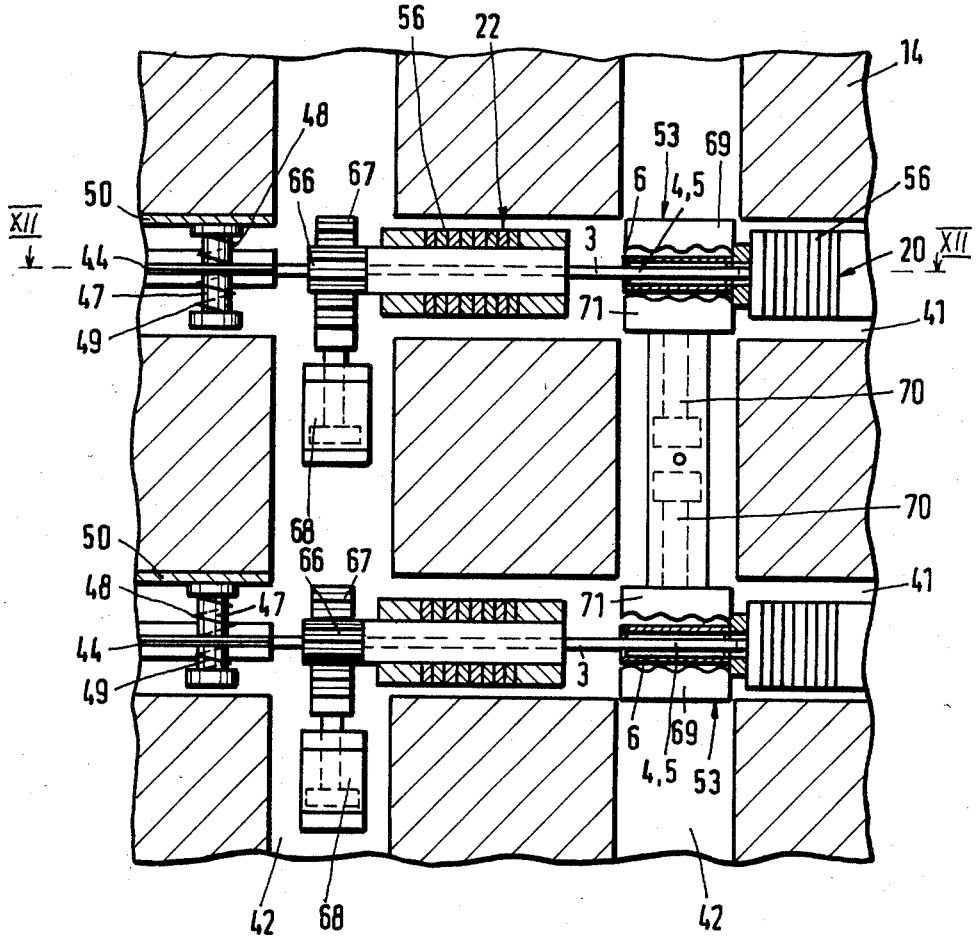
FIG. 9 shows a sectional view along the section line IX—IX in FIG. 6 and also shown on an enlarged scale.

FIG. 9 shows in a sectional view further structural components inside the pressing plate 14 or rather in the guide channels 41, 42 of the pressing plate 14 in the plane of the steel wire 3. More specifically, FIG. 9 shows the holding and seal securing mechanism 22 as well as the crimping tool 53 according to FIG. 6 and components of the bending mechanism 20.

Figure 11:
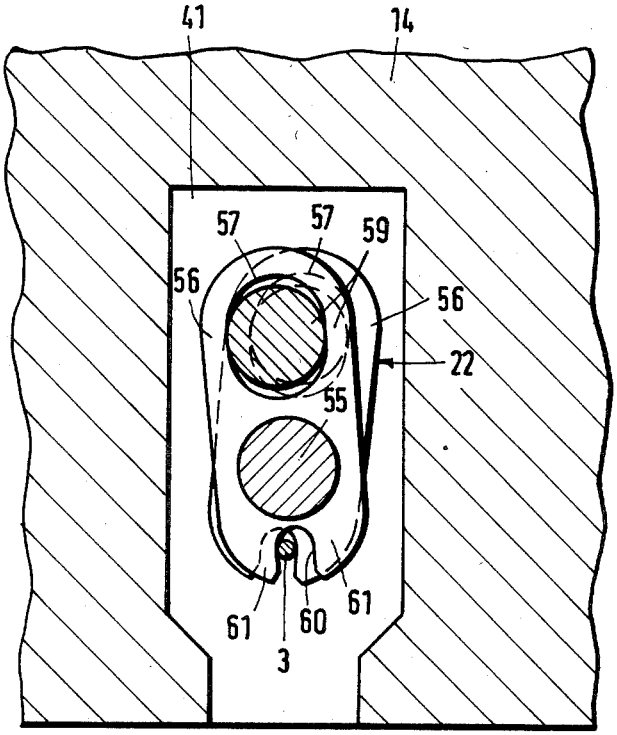
FIG. 11 is a sectional view along the section line XI—XI in FIG. 10, also on an enlarged scale.

The bending mechanism 20 and the holding and seal securing mechanism 22 comprise several disks 56 tiltable about an axis 55 as shown in FIG. 11 for holding that portion of a wire adjacent to the wire ends 4 or 5. Each of these disks 56 has the same construction and is freely tiltable on the common axis 55. A cam shaft 58 having one cam 59 for each disk 56 reaches through a bore 57 in these disks. A cut-out or recess 60 is located at the circumference of each disk 56 in such a manner that a steel wire 3 located in such a cut-out is clamped tight between the edges of adjacent cut-outs 60 which edges act as clamping jaws 61 when adjacent disks 56 are tilted relative to each other so that the cut-outs 60 tend to get out of alignment with each other. The disks 56 are tilted with the aid of the cam shaft 58. The steel wire 3 is released again by tilting the clamping disks 56 back into a position in which the cut-outs return into alignment with one another, whereby all the cut-outs are in register and the edges 61 cannot hold the wire 3 anymore.

Figure 10:
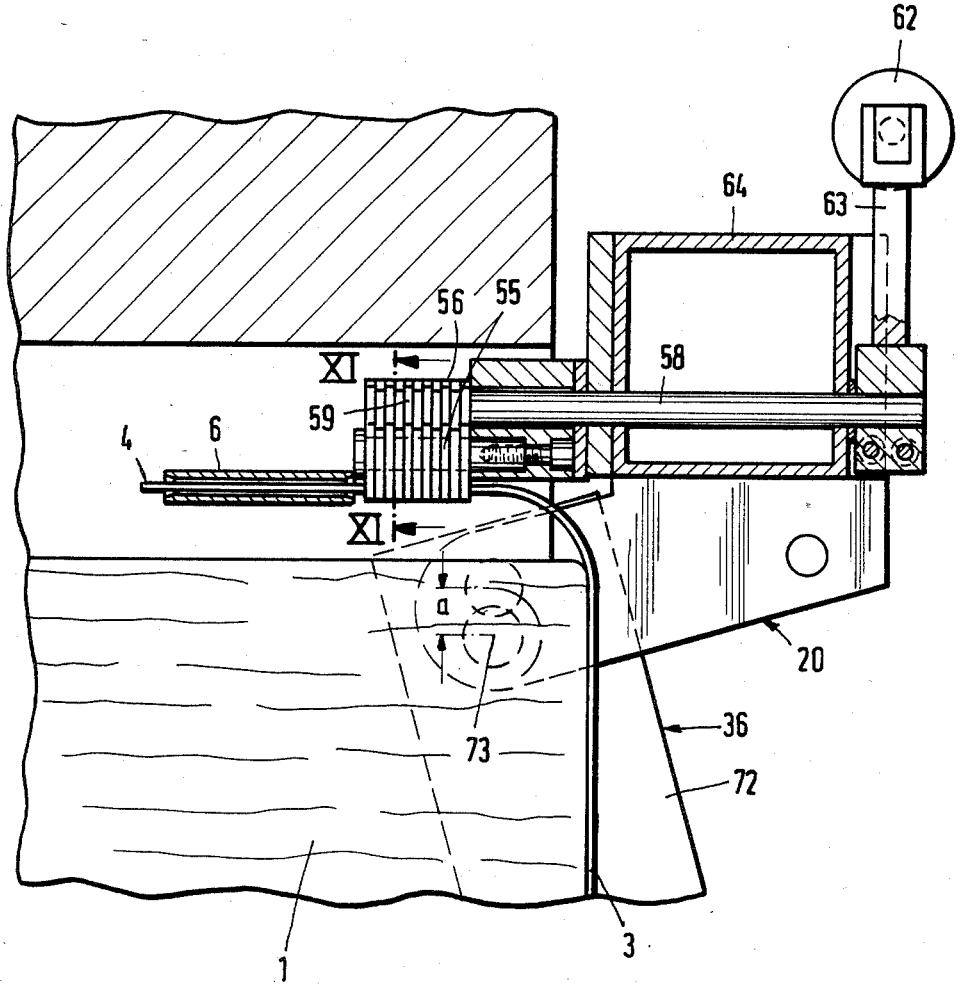
FIG. 10 shows, partially in section, the details of a wire bending mechanism on an enlarged scale.

The rotation of the cam shaft 58 in the bending mechanism 20 according to FIG. 10 is accomplished with a piston cylinder device 62 effective in two directions and operating a lever 63. The bending mechanism 20 comprises a shaft 55 for all the clamping disks 56 of each steel wire 3. The bending mechanism 20 further comprises a cam shaft 58 and a lever 63 which are mounted, for example on a carrier 64 having the shape of a square tube or pipe.

Figure 12:
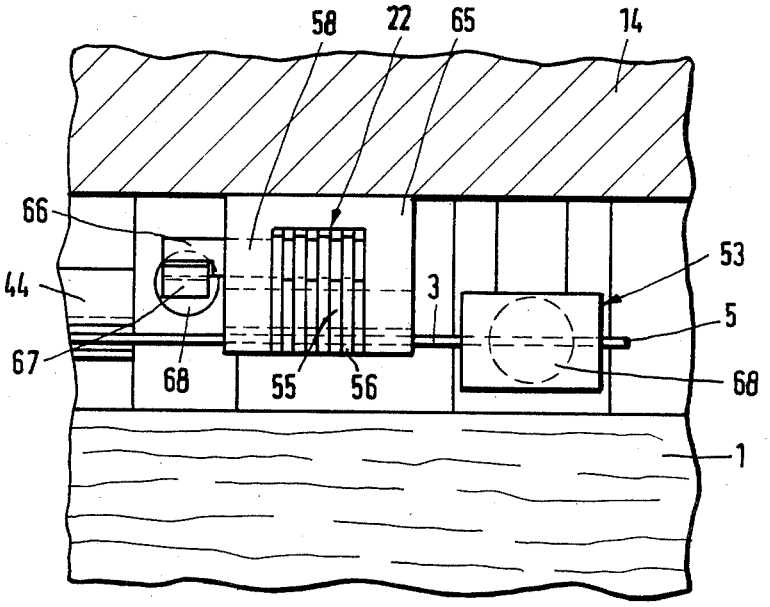
FIG. 12 shows on an enlarged scale a detail along the section line XII—XII in FIG. 9.

The clamping disks 56 of the holding and seal securing mechanism 22 as shown in FIG. 9 are held in place on the shaft 55 as shown in FIG. 12. The shaft 55 is supported by a U-shaped bracket 65. The cam shaft 58 is also supported in this bracket 65 and is driven by a piston cylinder arrangement 68 operating a pinion 66 and a rack 67 either pneumatically or hydraulically. During its work stroke the piston rod of the piston cylinder device 68 moves the clamping disks 56 into the holding position and it releases the clamping disks during its return stroke.

FIGS. 9 and 10 show further that the crimping tool 53 for securing the sleeve seals 6 comprises a fixed jaw 69 and a movable jaw 71 which is operable by means of a piston cylinder device 70. The crimping tools 53 become effective as soon as one wire end 4 with a metal sleeve 6 functioning as a seal attached thereto has been tilted by the tilting mechanism 19 and the bending mechanism 20 into the guide channel 41 and as soon as the other wire end 5 has also entered into the metal sleeve 6. After securing of the seal the clamping disks 56 of the bending mechanism 20 and the holding and seal securing mechanism 22 are being opened so that the steel wires 2, 3 and 8 may come out of the guide channels 31 and 32 or 41 and 42.

As is particularly illustrated in FIG. 10, the bending mechanism 20 is eccentrically and tiltably supported at one end 72 of the tilting arm 36. The bending mechanism 20 thus tilts not only about the bearing axis 73, but it moves additionally along an arc indicated by the dash-dotted line at a spacing "a" about the bearing axis 73. This feature has the advantage that the steel wires 2, 3 and 8 lie against the side of a fiber bale 1 in the desired manner and under tension.

The invention is not limited to the concrete example embodiments shown in the figures. Rather, many modifications may be made without deviating from the basic teaching of the invention. For example, it is possible that the holding and seal securing mechanism 22 and/or the crimping tool 53 are located not inside of the guide channels 41, 42 of the pressing plate 14 facing toward the bale, but rather, they may be located at any desired position, whereby these structural components may be mounted on or to the carriage or carriers 23, 24. In the same manner it is possible to locate these structural components in the counter pressure plate 15. It is further possible to achieve an eccentric movement of the bending mechanism 22 by employing, for example, a crankshaft bearing at the lower end of the tilting arm 36. It is merely essential that the wire tensioning mechanism comprising a plurality of components also includes at least one eccentrically tiltable wire tensioning element.

Although the invention has been described with reference to specific example embodiments, it will be appreciated, that it is intended, to cover all modifications and equivalents within the scope of the appended claims.

I claim:

1. A fiber bale wire hooping apparatus for surrounding a fiber bale in a baling press with a metal wire the ends of which are held together by a crimped metal sleeve, comprising a strapping mechanism including wire supply means (16) having wire feeding and tensioning means (17, 25) for supplying lengths of wire, wire guide means (21, 31, 41, 44) forming a guide channel along at least three sides around said fiber bale for guiding a length of wire around said fiber bale, wire end holding means (22) at an end of said guide channel for temporarily holding a forward free end of a wire, wire clamping and bending means (20) arranged downstream of said wire feeding and clamping means (17, 25) as viewed in a wire feed advance direction from said wire supply means (16) to said holding means, wire cutting means (18) arranged downstream of said feeding and tensioning means (17, 25) and upstream of said wire clamping and bending means (20) for cutting a wire after a wire has been first tensioned by said feeding and tensioning means (17, 25) and then clamped by said clamping and bending means (20), means (51) for automatically applying a metal sleeve (6) onto a cut end of a wire, means (19, 36, 35) for tilting said clamping and bending means (20) holding a wire end with a sleeve on said wire end toward said holding means (22), whereby a wire end protruding from said holding means is also inserted into said sleeve alongside said cut wire end, and means (70, 71) arranged for crimping said sleeve for tightly securing said wire ends to each other.

2. The apparatus of claim 1, comprising a first carriage, a first plurality of said strapping mechanisms and a first plurality of said guide means arranged for cooperation with each other on said first carriage means for tying wire hoops around said fiber bale in a first direction, a second carriage, a second plurality of said strapping mechanisms carried by said second carriage, a second plurality of said guide means carried on said first carriage in a position for cooperation with said second plurality of said strapping mechanisms on said second carriage for tying further wire hoops around said fiber bale in a second direction extending substantially at right angles to said first direction, (FIG. 5).

3. The apparatus of claim 1, wherein said wire supply means comprise driven roller means (25) for driving a wire in a feed advance direction and means for reversing the rotational direction of said roller means for tensioning said wire when a forward free end of said wire is held by said holding means (22).

4. The apparatus of claim 3, wherein said wire guide means comprise wire gaps which are open toward said fiber bale, and wherein said tensioning of said wire pulls a wire through said gap against said fiber bale.

5. The apparatus of claim 1, wherein said means for tilting said clamping and bending means (20) comprise a displaceable tilting axis (73) for simultaneously tilting and displacing said clamping and bending means (20) to further maintain the tension in the wire as the sleeve is being crimped.

6. The apparatus of claim 1, wherein said holding means (22) and said clamping and bending means each comprise a plurality of clamping disks (56) and a common journal axis (55), said disks (56) being arranged in a row on said common journal axis, each disk having a cut-out (60) on one side of said journal axis (55) for forming a wire clamping jaw (61) and a cam follower on the other side of said journal axis (55), a common cam shaft (58) with one cam (59) for each of said disks arranged for driving said disks between a jaw opening position and a jaw closing position, and means connected to said cam shaft for driving said cam shaft.

7. A fiber bale wire hooping apparatus for surrounding a fiber bale in a baling press with a metal wire the ends of which are held together by a crimped metal sleeve, comprising first and second carriage means movable relative to said baling press, a first plurality of strapping mechanisms on said first carriage means, a first corresponding plurality of guide means on said first carriage means arranged for cooperation with said first plurality of strapping mechanisms for tying wire hoops around said fiber bale in a first direction, a second plurality of guide means on said first carriage arranged substantially at right angles to said first plurality of guide means, a second plurality of strapping mechanisms arranged on said second carriage means for cooperation with said second plurality of guide means on said first carriage means for tying wire hoops around said fiber bale in a second direction extending substantially at right angles to said first direction, (FIG. 5).

* * * * *